US007770543B2

(12) United States Patent
Havlena et al.

(10) Patent No.: US 7,770,543 B2
(45) Date of Patent: Aug. 10, 2010

(54) CONTROL OF CFB BOILER UTILIZING ACCUMULATED CHAR IN BED INVENTORY

(75) Inventors: Vladimir Havlena, Prague (CZ); Daniel Pachner, Prague (CZ)

(73) Assignee: Honeywell International Inc., Morristown, NJ (US)

( * ) Notice: Subject to any disclaimer, the term of this patent is extended or adjusted under 35 U.S.C. 154(b) by 336 days.

(21) Appl. No.: 11/897,111

(22) Filed: Aug. 29, 2007

(65) Prior Publication Data

US 2009/0056603 A1 Mar. 5, 2009

(51) Int. Cl.
*F22D 5/26* (2006.01)

(52) U.S. Cl. ..... 122/4 D; 122/446; 122/448.1; 110/348

(58) Field of Classification Search ..... 122/4 D, 122/31.1, 34, 446, 448.1; 110/348
See application file for complete search history.

(56) References Cited

U.S. PATENT DOCUMENTS

| | | | | |
|---|---|---|---|---|
| 5,282,506 | A | 2/1994 | Ruottu | 165/104.18 |
| 5,343,830 | A | 9/1994 | Alexander et al. | 122/4 D |
| 5,363,812 | A * | 11/1994 | Belin et al. | 122/4 D |
| 5,957,063 | A * | 9/1999 | Koseki et al. | 110/188 |
| 6,058,858 | A | 5/2000 | Belin et al. | 110/245 |
| 6,322,603 | B1 | 11/2001 | Walker | 55/444 |
| 6,325,985 | B1 | 12/2001 | Koskinen et al. | 423/239.1 |
| 6,532,905 | B2 | 3/2003 | Belin et al. | 122/4 D |
| 6,622,645 | B2 * | 9/2003 | Havlena | 110/348 |
| 7,331,299 | B2 * | 2/2008 | Miyoshi et al. | 110/245 |
| 2005/0064357 | A1 | 3/2005 | Watanabe | 432/14 |
| 2007/0250214 | A1 * | 10/2007 | Lee et al. | 700/266 |

FOREIGN PATENT DOCUMENTS

| | | |
|---|---|---|
| EP | 0902235 B1 | 4/2003 |
| WO | WO 94/27716 | 12/1994 |

* cited by examiner

*Primary Examiner*—Gregory A Wilson
(74) *Attorney, Agent, or Firm*—Kermit D. Lopez; Luis M. Ortiz; Kris T. Fredrick

(57) ABSTRACT

A boiler control method and system. A BFI (bed fuel inventory) value associated with a boiler can be estimated by detecting data from the boiler utilizing an inferential sensor. The bed fuel inventory value can then be stabilized at a particular value utilizing a feedback controller electrically connected to the inferential sensor, in order to optimize the bed fuel inventory value for varying operating conditions of the boiler, thereby permitting a thermal power associated with the boiler to be increased or decreased faster by respectively increasing or decreasing a primary air supply rate associated with the boiler.

21 Claims, 4 Drawing Sheets

CONTROL OF CFB BOILER UTILIZING ACCUMULATED CHAR IN BED INVENTORY

TECHNICAL FIELD

Embodiments are generally related to CFB (Circulating Fluidized Bed) Boiler devices, systems and methods. Embodiments are also related to methods and systems for controlling CFB boilers.

BACKGROUND OF THE INVENTION

A circulating fluidized bed (CFB) boiler is a device for generating steam by burning fossil fuels in a combustion chamber operated under a special hydrodynamic condition. The CFB technique is commonly implemented in combustion and gassing processes. The essential advantage of the circulating fluidized bed technique in comparison with other reaction types is the excellent material and heat transfer between the particles and the gas. By using a sufficient gas velocity, a nearly isothermic state is produced in the reactor. This essentially facilitates the managing of the combustion and gassing processes.

CFB boilers can be briefly characterized as follows. Several tons of fine solid particles (e.g., sand and ashes) with a small addition of fuel particles are suspended in a powerful primary air stream blown from the bottom of the boiler. If the air velocity is chosen properly, the solid particles dragged by the gas stream exhibit behavior very similar to a boiling liquid. This phenomenon achieved by the primary air stream is called fluidization and the suspended material is referred to as the fluidized bed. At the same time, the fuel particles are burnt in these conditions in order to generate heat captured by water to produce steam. The fuel has to be supplied continuously to continue the operation.

Fluidized bed combustors are distinguished by low emissions and their capability to burn fuels of low or variable quality, such as turf or lignite. The reason is the fluidization conditions allow low combustion temperatures (e.g., approximately 800-900 deg of Celsius) under which almost no nitrogen oxides emissions arise. Also, the low temperatures and slow combustion allow the limestone to be added to the bed to capture sulfur oxides effectively. On the other hand it is assumed the CFB boilers are difficult to change their thermal power abruptly. This limits their use as it is often required to change the boiler thermal power according to varying load in the electrical grid.

It is therefore believed that a need exists for an improved control method and system for achieving an enhanced dynamic response of the CFB boiler load, as is disclosed in greater detail herein.

BRIEF SUMMARY OF THE INVENTION

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole.

It is, therefore, one aspect of the present invention to provide for an improved method and system for controlling a CFB boiler.

It is another aspect of the present invention to provide for an improved method and system for achieving an enhanced dynamic response of a CFB boiler load.

The aforementioned aspects of the invention and other objectives and advantages can now be achieved as described herein. A boiler control method and system are disclosed. A BFI (bed fuel inventory) value associated with a boiler can be estimated from measurable data (via sensing) from the boiler utilizing an inferential sensor. The bed fuel inventory value can then be stabilized at a particular value utilizing a feedback controller electrically connected to the inferential sensor, in order to optimize the bed fuel inventory value for varying operating conditions of the boiler, thereby permitting a thermal power associated with the boiler to be increased or decreased by respectively increasing or decreasing a primary air supply rate associated with the boiler.

A feedback loop can also be provided with respect to the feedback controller, the inferential sensor and the boiler such that the feedback controller changes the primary air supply rate and a fuel supply rate of the boiler accordingly in order to simultaneously stabilize the thermal power and the bed fuel inventory value. The feedback controller functions in a manner that permits the thermal power of the boiler to possess a greater priority than the bed fuel inventory value. Stabilizing the bed fuel inventory value ensures that the operation of the boiler is approximately close to an assumed optimal operational point during all operations of the boiler.

Additionally, the inferential sensor is configured to assist in estimating the bed fuel inventory value from among a group of process variables associated with the boiler. Such variables can be utilized as input to the inferential sensor and may comprise one or more of the following variables: output flue gas oxygen concentration, bed temperature, steam pressure, steam flow, steam temperature, primary air flow, secondary airflow, and fuel supply rates.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

The particular values and configurations discussed in these non-limiting examples can be varied and are cited merely to illustrate at least one embodiment of the present invention and are not intended to limit the scope of the invention.

Figure 1:
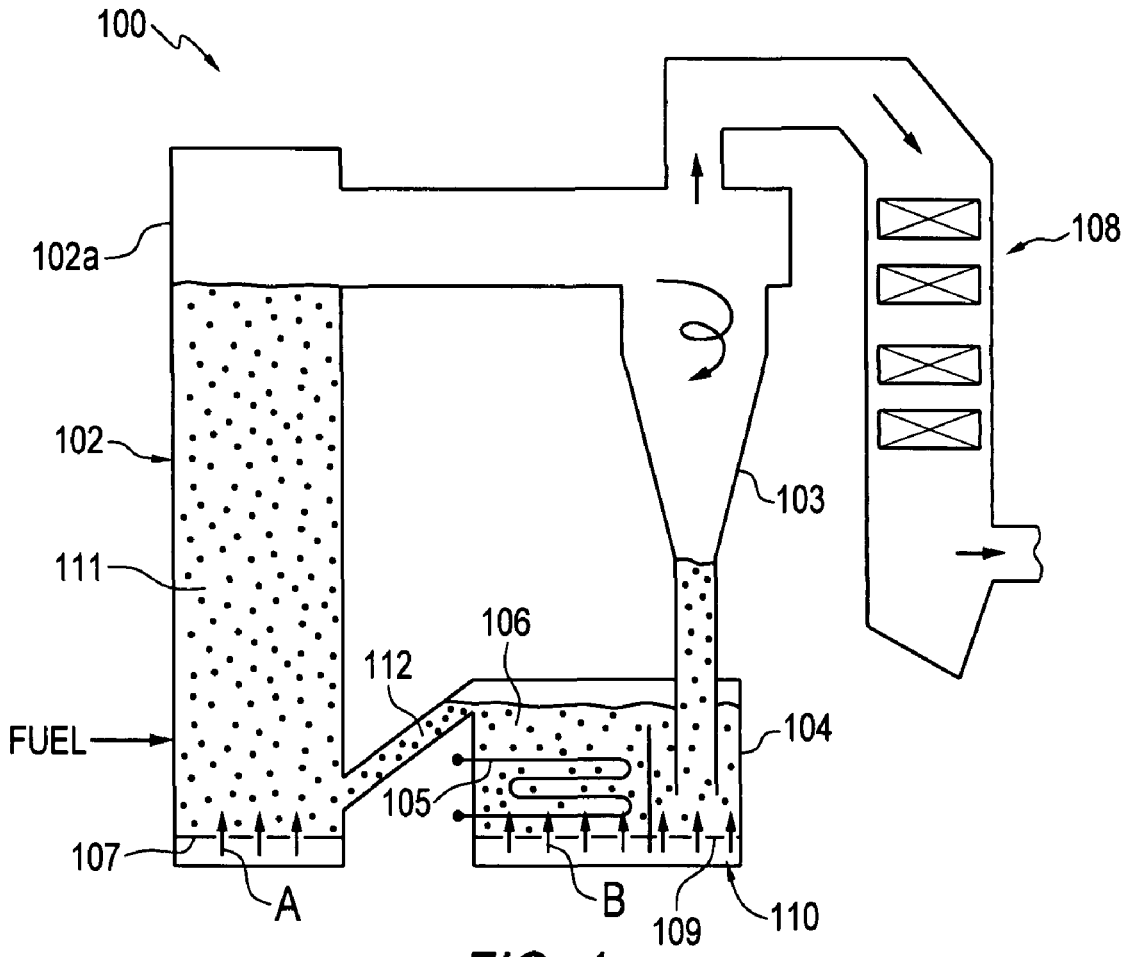
FIG. 1 illustrates a pictorial side view of a CFB (Circulating Fluidized Bed) boiler, which can be implemented in accordance with a preferred embodiment.

FIG. 1 illustrates a pictorial side view of a CFB (Circulating Fluidized Bed) boiler 100, which can be implemented in accordance with a preferred embodiment. It can be appreciated that the CFB boiler 100 depicted in FIG. 1 represents merely one type of a CFB boiler that can be adapted for use in accordance with the disclosed embodiments. A variety of other CFB boiler types and configurations can be utilized in accordance with preferred or alternative embodiments, depending on design goals and considerations. Generally, the circulating fluidized bed boiler 100 comprises a furnace 102, a cyclone dust collector 103 into which flue gas which is generated by the combustion in the furnace 102 flows and which catches particles which are contained in the flue gas, a seal box 104 into which the particles which are caught by the cyclone dust collector 103 flow and external heat exchanger 106 which performs heat exchange between the circulating particles and in-bed tubes in the heat exchanger 106.

The furnace 102 includes a water cooled furnace wall 102*a* and an air distribution nozzle 107 which introduces fluidizing air A to the furnace 102 so as to create a fluidizing condition in the furnace 102 is arranged in a bottom part of the furnace 102. The cyclone dust collector 103 can be connected to an upper part of the furnace 102. An upper part of the cyclone dust collector 103 can be connected to the heat recovery area 108 into which flue gas which is generated by the combustion in the furnace 102 flows, and a bottom part of the cyclone dust collector 1-3 is connected with the seal box 104 into which the caught particles flows. A super heater and economizer etc. can be contained in the heat recovery area 108.

An air box 110 can be arranged in a bottom of the seal box 104 so as to intake upward fluidizing air B through an air distribution plate 109. The particles in the seal box 4 are introduced to the external heat exchanger 106 and are in-bed tube 105 under fluidizing condition. In the furnace of the above explained circulating fluidized bed boiler, bed materials 111 which comprise ash, sand and limestone etc. are under suspension by the fluidizing condition.

Most of the particles entrained with flue gas escape the furnace 102 and are caught by the cyclone dust collector 103 and are introduced to the seal box 104. The particles thus introduced to the seal box 104 are aerated by the fluidizing air B and are heat exchanged with the in-bed tubes 105 of the external heat exchanger 106 so as to be cooled. The particles are returned to the bottom of the furnace 102 through a duct 112 so as to circulate through the furnace 102.

Note that boiler 100 represents merely one example of a CFB boiler to which the method and system disclosed herein can be adapted. For example, another type of boiler that can be utilized to implement boiler 100 in accordance with an alternative embodiment is the CFB boiler disclosed in U.S. Pat. No. 6,532,905, entitled "CFB With Controllable In-Bed Heat Exchanger" which issued to Belin et al on Mar. 13, 2003, and is incorporated herein by reference in its entirety. Another example of a boiler than can be utilized to implement boiler 100 in accordance with another embodiment is the CFB boiler disclosed in U.S. Pat. No. 6,325,985, entitled "Method and Apparatus for Reducing NOX Emissions in CFB Reactors Used for Combustion of Fuel Containing Large Amounts of Volatile Components" which issued to Koskinen et al Dec. 4, 2001 and is incorporated herein by reference in its entirety. Thus, alternative embodiments may employ different types of CFB boilers. It is understood that the present invention is not limited to the specific configuration of boiler 100 illustrated in FIG. 1, but can be provided by a wide variety of CFB boiler configurations and designs.

Figure 2:
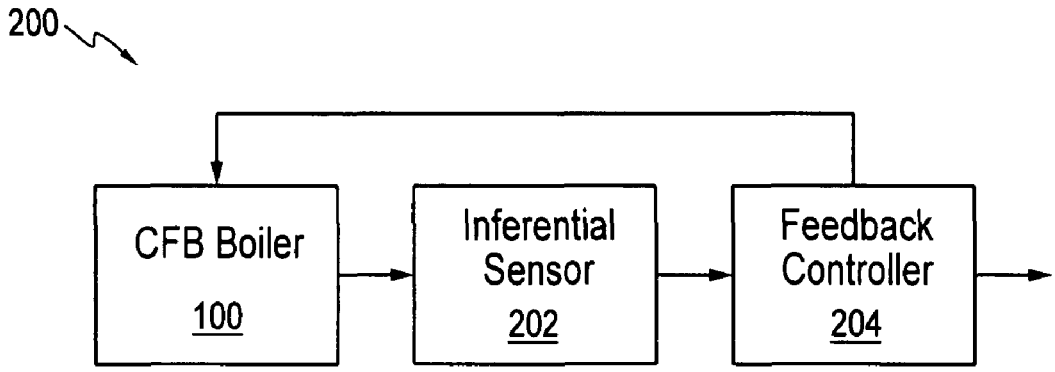
FIG. 2 illustrates a high-level block diagram of a system that includes the CFB boiler of FIG. 1 in association with an algorithmic inferential sensor and a feedback controller, in accordance with a preferred embodiment.

FIG. 2 illustrates a high-level block diagram of a system 200 that includes the CFB boiler 100 of FIG. 1 in association with an algorithmic inferential sensor 202 and a feedback controller 204, in accordance with a preferred embodiment. Note that in FIGS. 1-2, identical or similar parts or elements are generally indicated by identical reference numerals. System 200 is based on the utilization of bed char inventory, such that the CFB thermal power associated with boiler 100 can be decreased or increased faster by altering the primary air flow. There are typically several tens or hundreds of kilograms of the unburned fuel in the bed.

This amount is defined by the equilibrium between the burning rate and the fuel supply rate and referred to as the BFI, bed fuel inventory. System 200 is based on an improved control method that (i) estimates BFI and (ii) stabilizes BFI at certain desired value which can be optimized for varying boiler 100 operating conditions (load). If the BFI is stabilized it is then possible to increase or decrease the boiler thermal power by increasing or decreasing primary air. The change of burning rate invoked by the primary air change is almost immediate, without the need to increase the BFI, which always takes some time as the fuel has to be transported to the bed. Apart from the dynamic response acceleration of CFB boiler 100, such an improved control methodology and system has the advantage that BFI stabilization also stabilizes the boiler 100 dynamic response to the changes in the fuel and primary air supply rates which greatly simplifies the feedback control algorithm and improves its operation.

Data from CFB boiler 100 can be used as input (i.e., measured, sensed, etc) for the inferential sensor 202 and supplied as sensor output data, which is input to the feedback controller 204 in a loop configuration. The feedback controller 204 makes use of the output from the inferential sensor 202. The inferential sensor 202 estimates the current BFI value. Thereafter, this estimate can be utilized in the feedback loop of system 200 as if it were a sensed quantity. The BFI value cannot be metered directly by any sensor and the algorithmic inferential sensor 202 is preferred for use in calculating the BFI value from the other quantities measured.

The feedback controller 204 can then change the primary air and the fuel supply rates associated with the CFB boiler 100 accordingly to stabilize the CFB power and BFI at the same time. The feedback controller 204 operates in a manner that permits the boiler 100 thermal power to have a greater priority than the BFI value, which is allowed to a range. Thus, if an abrupt power step up is required, the feedback controller 204 increases the burning rate, thereby increasing the power immediately. The BFI is temporarily decreased. At the same time, the fuel supply rate can also be increased by the controller 204 so that the BFI value can be recovered eventually.

Figure 3:
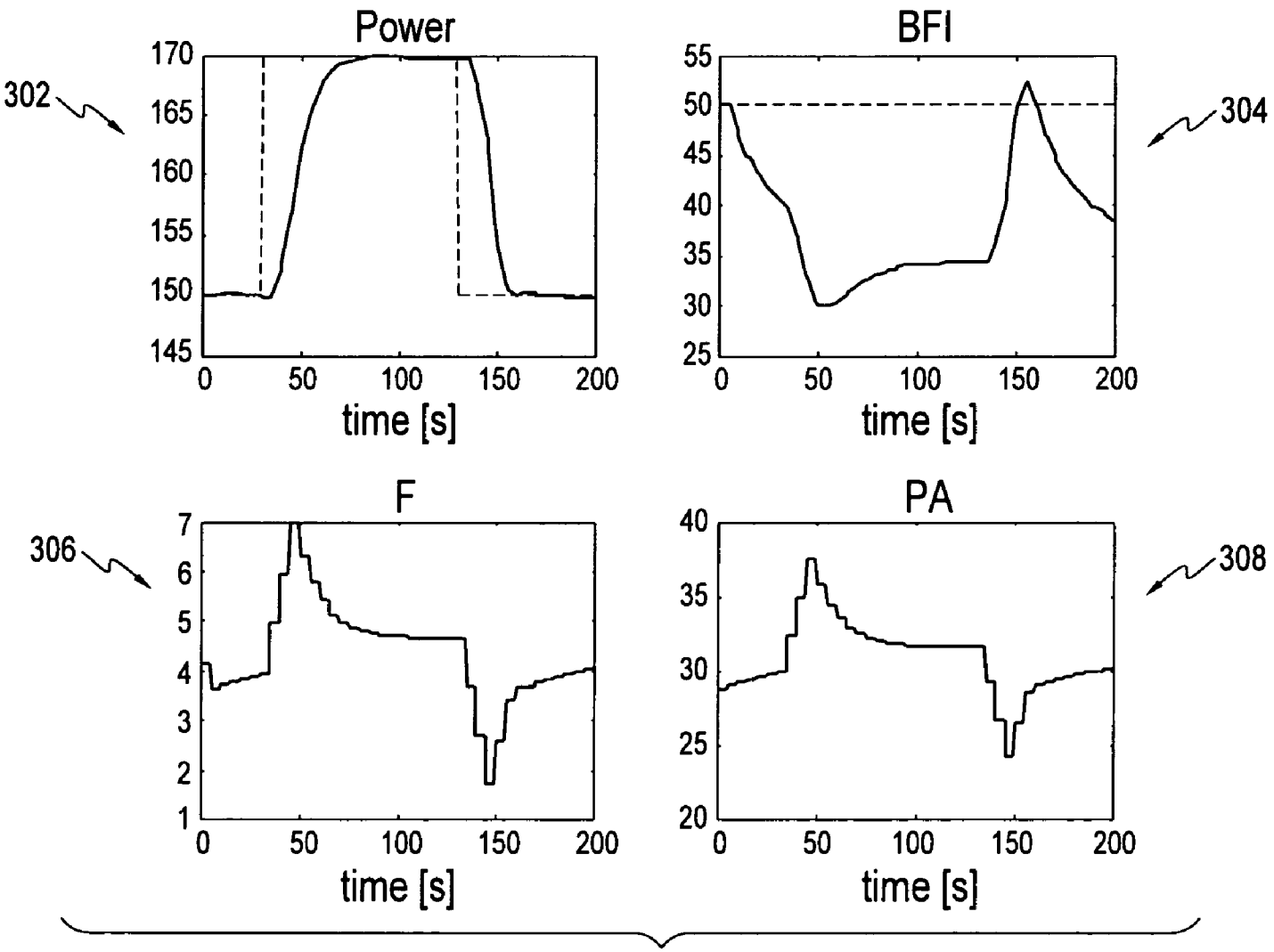
FIG. 3 (Prior Art)
FIGS. 3-4 illustrates a group of graphs depicting data collecting from a prior art boiler control methodology.
Figure 4:
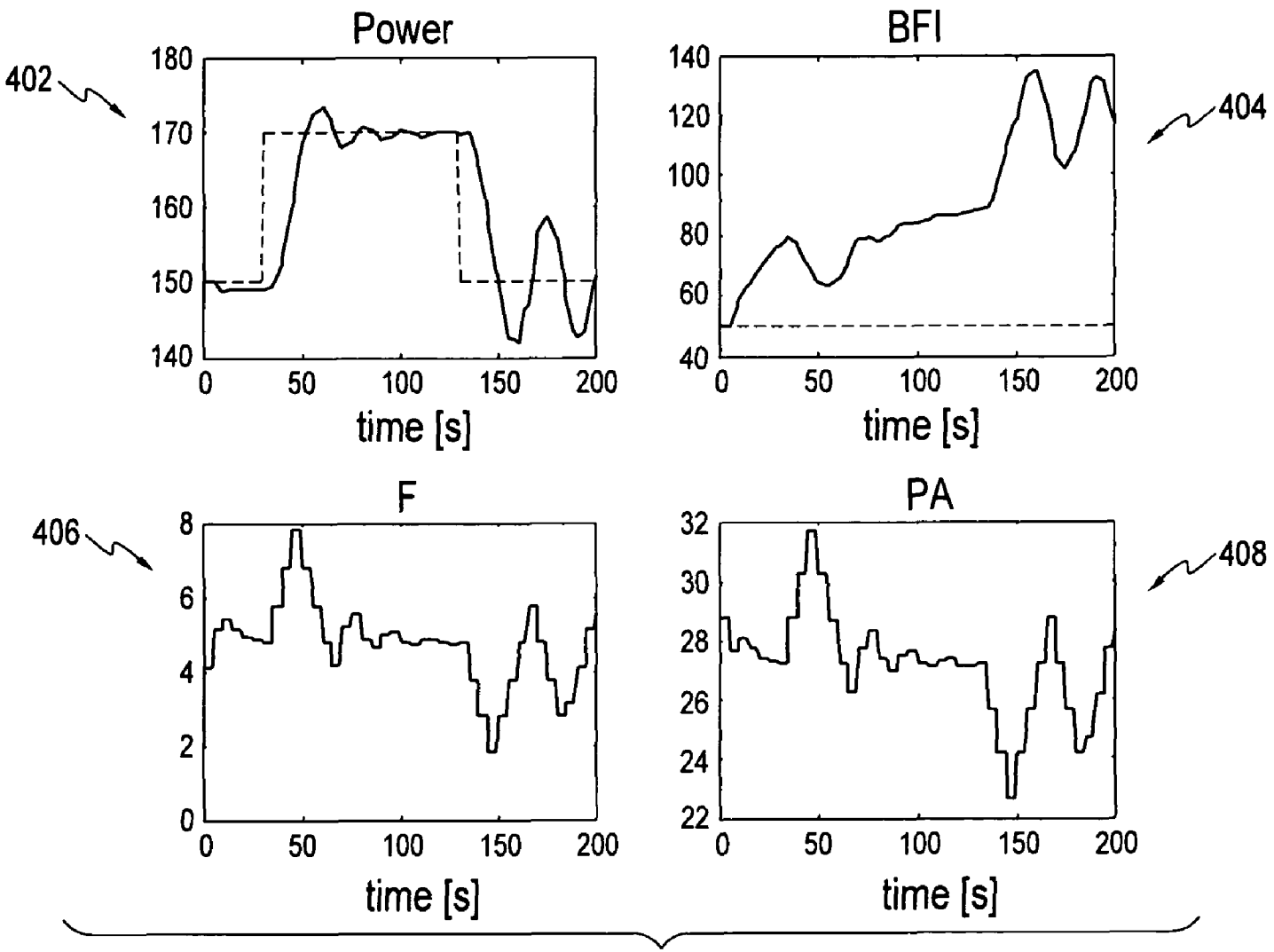
FIG. 4 (Prior Art)
Figure 5:
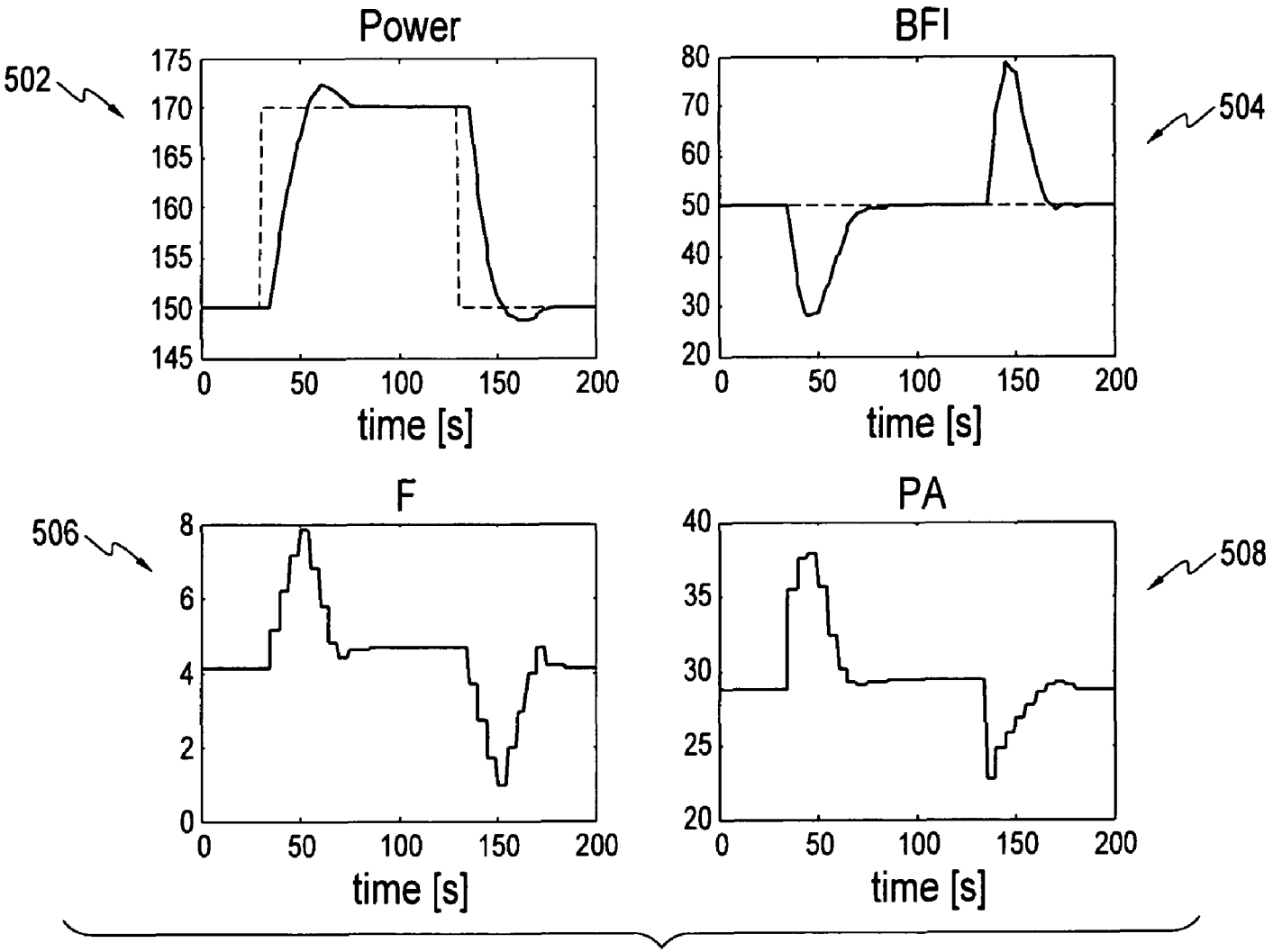
FIG. 5 illustrates a group of graphs depicting data collected with respect to a boiler, in accordance with a preferred embodiment.

Reference is now made to FIG. 3, which illustrates graphs 302, 304, 306 and 308, which depict data collected from a prior art control method. FIG. 4 illustrates graphs 402, 404, 406, and 408, which respectively depict data collected with respect to another prior art control method. FIG. 5 illustrates, on the other hand, graphs 502, 504, 506, and 508, which depict data collected with respect to the improved methods and systems disclosed herein. FIGS. 3-4 can thus be compared to the disclosed novel CFB boiler thermal power control strategies as exemplified by the data collected with respect to 502, 504, 506, and 508 of FIG. 5. The comparison of FIGS. 3-4 and FIG. 5 was generated by simulating a non-linear mathematical model of an existing, 300 MW boiler. Hence, the data presented with respect to FIGS. 3-4 and FIG. 5 was generated via a computer simulation, rather than an actual boiler operation.

To compare the two control strategies, simulated a step change in the boiler power demand from 150 MW to 170 MW and then back to 150 MW can be simulated. The assumed sampling period can be, for example, 5 seconds. For the purpose of comparison, the novel (e.g., FIG. 5) and the prior art control systems (e.g., FIGS. 3-4) were designed for the boiler model. These were set to behave almost identically at the operation point defined as follows: power 150 MW, 50 kg of the unburned char in the boiler inventory. The simulations demonstrate the boiler operation starting from this point.

Because of these parameters, the comparison should pronounce the difference in the boiler behavior achieved due to the utilization of unburned char mass (the idea disclosed), not the differences due to different setting of the two control system parameters. The simulation focuses the following process variables:

1. F [kg/s], Fuel supply rate
2. PA [$m^3$/s], Primary Air supply rate
3. BFI [kg], Bed Fuel Inventory, the mass of the unburned fuel present in the material of boiler bed
4. Power [MW], thermal energy rate transferred to the steam

Conventional Control

The prior art control law manipulates the fuel supply rate to control the boiler thermal power using a feedback controller. The primary air supply rate is manipulated as a function of the fuel supply rate. The boiler manufacturer supplies a control curve stating how the F and PA should be coordinated. Hence, the control system increases (decreases) the fuel supply rate if the actual power is lower (higher) than the target value. The boiler power is directly related to the steam flow generated [t/hr].

The prior art control operation can be examined, for example, with respect to FIG. 3, which illustrates a CFB boiler computer simulated operation. The controller is set optimally for the operation point. At time 25 the boiler output is required to change from 150 MW to 170 MW. At time 125 the required output is changed back. The BFI values from that simulated operation converge to 30-35 kg depending on the boiler power. It may be shown that this value depends on the way how the F and PA variables are coordinated.

Slightly different coordination curve can lead to higher BFI values, as shown on FIG. 4. This coordination curve supplies less air volume per 1 kg of fuel, but the difference compared to the previous example is small: 2 $m^3$/s less air approximately. Here the BFI value increased above 100 kg. This setting drove the boiler state off the assumed operation point for which the control system was tuned optimally. As a result, the power control is oscillatory. Such control would be quite unsatisfactory. Note that in these figures, the dashed lines mark the desired values (command), the thick lines mark the actual process values obtained by numerical simulation.

Control Utilizing the Accumulated Char in the Bed Inventory

The disclosed control operation can be examined with respect to FIG. 5. Here the control system manipulates both PA and F in order to achieve the desired thermal power and stabilize the BFI at the target value set to 50 kg at the same time. Because the thermal power tracking has a higher priority, the BFI drops to 30 kg after the power step change. But the control system recovered it back to the target 50 kg after 30 seconds approximately. Thus, both BFI and thermal power are controlled to the target values, though with different priority.

Comparison of the Two Controls

The prior art control system does not stabilize the BFI value. As a result, the BFI value may change in a range unpredictably. Then, either of two situations may occur. First, the BFI value increases above the optimal level which means the boiler power control feedback gain is higher than it should be. An unstable or oscillatory operation may follow. To prevent such situation it may be necessary to set the feedback controller gain lower (suboptimal) therefore. This will further worsen the control system responsiveness. The control may be sluggish. Second, the BFI value decreases below the optimal level which may deteriorate the boiler responsiveness to power increments as there will not be enough fuel to burn.

It is implied by the physics the boiler bed temperature would follow this BFI unpredictable pattern. High BFI figures mean high bed temperature. This is undesirable as the boiler emissions formation rates like $SO_2$ and $NO_x$ are highly temperature dependent. Also, the desulphurization efficiency is highly temperature dependant. Moreover, temperature fluctuations affect the boiler thermal efficiency and its lifetime.

In contrast, the disclosed control method/system (e.g., see FIGS. 1-2 and FIG. 5) stabilizes the BFI value explicitly. This ensures that the boiler operation is close to the assumed optimal operation point at all times. The feedback controller gain with respect to controller 204, for example, is well defined. Also, the bed temperature is better stabilized, which implies better emission control and optimal desulphurization efficiency. Finally, the BFI can be used to increase the burning rate temporarily thus increasing the boiler power even faster than the fuel supply rate is able to increase. A part of the set BFI can be burnt to increase the power very fast temporarily.

The degree of optimality of the conventional control depends on the fuel air coordination curve supplied by the boiler manufacturer. Because the optimal curve depends on the fuel properties, the weight of the bed material etc. it is difficult to set this curve to be optimal at all times. To control the BFI, the improved control system/method disclosed herein, preferably utilizes the inferential sensor 204, which estimates the BFI value from the other process variables measured. Among these the following metered variables may appear:

1. Output flue gases oxygen concentration
2. Bed Temperature
3. Steam pressure, flow, and temperature
4. Primary air flow
5. Secondary air flow
6. Fuel supply rate Out of those metered variables the BFI may be estimated in real time based on a CFB boiler physical model using a data-fitting estimation algorithm. As a result, the proposed CFB boiler power control utilizing the BFI information is much more complicated because it must contain a complex non-linear estimation algorithm. But it leads to better boiler responsiveness to abrupt power changes and better bed temperature stabilization which achieves to better emission values, better efficiency and better lifetime.

FIGS. 3-4 and 5 therefore generally describe a boiler control method by estimating a bed fuel inventory value associated with the boiler 100 by detecting data from the boiler utilizing an inferential sensor. Thereafter, the bed fuel inventory value can be stabilized at a particular value utilizing the feedback controller 204 electrically connected to the inferential sensor 204, in order to optimize the bed fuel inventory value for varying operating conditions of the boiler 100, thereby permitting a thermal power associated with the boiler 100 to be increased or decreased by respectively increasing or decreasing a primary air supply rate associated with the boiler 100.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The embodiments of the invention in which an exclusive property or right is claimed are defined as follows. Having thus described the invention what is claimed is:

1. A boiler control system, comprising:

a boiler;

an inferential sensor connected to said boiler, wherein said inferential sensor assists in estimating a bed fuel inventory value associated with said boiler by detecting data from said boiler;

a feedback controller for stabilizing said bed fuel inventory value at a particular value, said feedback controller electrically connected to said inferential sensor, in order to optimize said bed fuel inventory value for varying operating conditions of said boiler, thereby permitting a thermal power associated with said boiler to be increased or decreased by respectively increasing or decreasing a primary air supply rate associated with said boiler; and a feedback loop with respect to said feedback controller, said inferential sensor and said boiler such that said feedback controller changes said primary air supply rate and a fuel supply rate of said boiler accordingly in order to simultaneously stabilize said thermal power and said bed fuel inventory value.

2. The system of claim 1 wherein said feedback controller functions in a manner that permits said thermal power of said boiler to possess a greater priority than said bed fuel inventory value.

3. The system of claim 1 wherein stabilizing said bed fuel inventory value ensures that the operation of said boiler is approximately close to an assumed optimal operational point of said boiler during all operations of said boiler.

4. The system of claim 1 wherein said inferential sensor assists in estimating said bed fuel inventory value from among a plurality of process variables associated with said boiler, said plurality of process variables measured by said inferential sensor.

5. The system of claim 4 wherein said plurality of process variables comprises at least one of the following process variables: output flue gas oxygen concentration, bed temperature, steam pressure, steam flow, steam temperature, primary air flow, secondary airflow, and fuel supply rates.

6. The system of claim 1 wherein said boiler comprises a CFB boiler.

7. The system of claim 1 further comprising a mechanism for automatically regulating a power control associated with said boiler utilizing said bed fuel inventory value based on a non-linear estimation.

8. The system of claim 1 wherein said plurality of process variables comprises the following variables: output flue gas oxygen concentration, bed temperature, steam pressure, steam flow, steam temperature, primary air flow, secondary airflow, and fuel supply rates.

9. The system of claim 1 wherein said feedback controller functions in a manner that permits said thermal power of said boiler to possess a greater priority than said bed fuel inventory value and wherein stabilizing said bed fuel inventory value ensures that the operation of said boiler is approximately close to an assumed optimal operational point of said boiler during all operations of said boiler.

10. The system of claim 1 wherein said inferential sensor assists in estimating said bed fuel inventory value from among a plurality of process variables associated with said boiler, said plurality of process variables measured by said inferential sensor and wherein stabilizing said bed fuel inventory value ensures that the operation of said boiler is approximately close to an assumed optimal operational point of said boiler during all operations of said boiler.

11. The system of claim 1 further comprising a mechanism for automatically regulating a power control associated with said boiler utilizing said bed fuel inventory value based on a non-linear estimation and wherein said boiler comprises a CFB boiler.

12. The system of claim 1 further comprising a mechanism for automatically regulating a power control associated with said boiler utilizing said bed fuel inventory value based on a non-linear estimation, wherein said plurality of process variables comprises at least one of the following process variables: output flue gas oxygen concentration, bed temperature, steam pressure, steam flow, steam temperature, primary air flow, secondary airflow, and fuel supply rates.

13. The system of claim 1 wherein:

said feedback controller functions in a manner that permits said thermal power of said boiler to possess a greater priority than said bed fuel inventory value;

stabilizing said bed fuel inventory value ensures that the operation of said boiler is approximately close to an assumed optimal operational point of said boiler during all operations of said boiler; and said inferential sensor assists in estimating said bed fuel inventory value from among a plurality of process variables associated with said boiler, said plurality of process variables measured by said inferential sensor.

14. The system of claim 13 wherein said boiler comprises a CFB boiler.

15. The system of claim 13 further comprising a mechanism for automatically regulating a power control associated with said boiler utilizing said bed fuel inventory value based on a non-linear estimation.

16. A boiler control system, comprising:

a boiler;

an inferential sensor connected to said boiler, wherein said inferential sensor assists in estimating a bed fuel inventory value associated with said boiler by detecting data from said boiler;

a feedback controller for stabilizing said bed fuel inventory value at a particular value, said feedback controller electrically connected to said inferential sensor, in order to optimize said bed fuel inventory value for varying operating conditions of said boiler, thereby permitting a thermal power associated with said boiler to be increased or decreased by respectively increasing or decreasing a primary air supply rate associated with said boiler; and a feedback loop with respect to said feedback controller, said inferential sensor and said boiler such that said feedback controller changes said primary air supply rate and a fuel supply rate of said boiler accordingly in order to simultaneously stabilize said thermal power and said bed fuel inventory value, wherein said feedback controller functions in a manner that permits said thermal power of said boiler to possess a greater priority than said bed fuel inventory value.

17. The system of claim 16 wherein stabilizing said bed fuel inventory value ensures that the operation of said boiler is approximately close to an assumed optimal operational point of said boiler during all operations of said boiler.

18. The system of claim 16 wherein said inferential sensor assists in estimating said bed fuel inventory value from among a plurality of process variables associated with said boiler, said plurality of process variables measured by said inferential sensor.

19. The system of claim 16 wherein said boiler comprises a CFB boiler.

20. A boiler control system, comprising:

a boiler;

an inferential sensor connected to said boiler, wherein said inferential sensor assists in estimating a bed fuel inventory value associated with said boiler by detecting data from said boiler;

a feedback controller for stabilizing said bed fuel inventory value at a particular value, said feedback controller electrically connected to said inferential sensor, in order to optimize said bed fuel inventory value for varying operating conditions of said boiler, thereby permitting a thermal power associated with said boiler to be increased or decreased by respectively increasing or decreasing a primary air supply rate associated with said boiler; and a feedback loop with respect to said feedback controller, said inferential sensor and said boiler such that said feedback controller changes said primary air supply rate and a fuel supply rate of said boiler accordingly in order to simultaneously stabilize said thermal power and said bed fuel inventory value, wherein said inferential sensor assists in estimating said bed fuel inventory value from among a plurality of process variables associated with said boiler, said plurality of process variables measured by said inferential sensor.

21. The system of claim 20 further comprising:

a mechanism for automatically regulating a power control associated with said boiler utilizing said bed fuel inventory value based on a non-linear estimation;

wherein said feedback controller functions in a manner that permits said thermal power of said boiler to possess a greater priority than said bed fuel inventory value;

wherein stabilizing said bed fuel inventory value ensures that the operation of said boiler is approximately close to an assumed optimal operational point of said boiler during all operations of said boiler.

* * * * *